US005301870A

United States Patent [19]

Smith et al.

[11] Patent Number: 5,301,870

[45] Date of Patent: Apr. 12, 1994

[54] SCOOP

[75] Inventors: Preston M. Smith, Westminster; Dominic Marazita, Phoenix, both of Md.

[73] Assignee: Lever Brothers Company, Division of Conopco, Inc., New York, N.Y.

[21] Appl. No.: 990,813

[22] Filed: Dec. 14, 1992

Related U.S. Application Data

[63] Continuation of Ser. No. 812,595, Dec. 23, 1991.

[51] Int. Cl.[5] ..... B65D 5/18

[52] U.S. Cl. ..... 229/1.5 B; 229/902

[58] Field of Search ..... 229/1.5 B, 1.5 R, 117.12, 229/902

[56] References Cited

U.S. PATENT DOCUMENTS

| | | | |
|---|---|---|---|
| 1,690,586 | 11/1928 | Main . | |
| 1,800,534 | 4/1931 | Jannings | 229/1.5 B |
| 1,902,072 | 3/1933 | Harrod . | |
| 1,931,213 | 10/1933 | Wheeler | 229/1.5 B |
| 2,002,215 | 5/1935 | Blitz | 229/1.5 B |
| 2,128,466 | 8/1938 | Machotka | 229/1.5 B |
| 2,226,178 | 12/1940 | Page . | |
| 2,749,018 | 6/1956 | Berke . | |
| 3,073,506 | 1/1963 | Ullger . | |
| 3,357,623 | 12/1967 | Wommelsdorf | 229/1.5 B |
| 3,373,917 | 3/1968 | Cox . | |
| 4,074,849 | 2/1978 | Davidsson et al. | 229/1.5 B |
| 4,185,764 | 1/1980 | Cote | 229/1.5 B |
| 4,267,955 | 5/1981 | Struble | 229/1.5 B |
| 4,412,644 | 11/1983 | La Fever | 229/1.5 B |
| 4,428,500 | 1/1984 | Kohler . | |
| 4,502,623 | 3/1985 | Moore, Jr. et al. | 229/1.5 B |
| 4,711,389 | 12/1987 | Alba et al. | 229/1.5 B |
| 4,718,595 | 1/1988 | Jones | 229/1.5 B |
| 4,760,950 | 8/1988 | Levick | 383/2 |
| 4,867,374 | 9/1989 | Murray et al. | 229/1.5 B |
| 4,915,235 | 4/1990 | Roosa . | |
| 4,955,528 | 9/1990 | Schluckebier | 229/1.5 B X |

*Primary Examiner*—Allan N. Shoap
*Assistant Examiner*—Christopher McDonald
*Attorney, Agent, or Firm*—Gerard J. McGowan, Jr.

[57] ABSTRACT

A paper scoop particularly suitable for use in concentrated detergent cartons. The scoop is formed from a blank of paperboard which includes a front panel, a bottom panel, a rear panel and two side panels on either side of the front panel. The side panels include handle apertures. When erected from the paperboard blank, the scoop can assume two positions: a flattened tubular position wherein the bottom panel is folded along a bisecting scoreline and an erected position wherein the bottom panel is snapped open whereby the bottom panel is disposed generally perpendicularly to the plane of the flattened scoop.

22 Claims, 2 Drawing Sheets

34
42
38
24
20
60
18
126
62
66
120
12
30
128
62
64
130
14
22
16
10
32
36
40

SCOOP

This is a continuation application of Ser. No. 07/812,595 filed Dec. 23, 1991.

BACKGROUND OF THE INVENTION

In order to reduce the amount of storage space taken up by laundry detergents and to minimize the amount of packaging materials used, superconcentrated detergents and superconcentrated detergent cartons have been developed. Superconcentrated detergent cartons tend to be shorter and wider than typical detergent cartons. Since they are wider than ordinary detergent cartons, they are not so readily grasped along their narrow sides for pouring by the consumer.

One solution to the problem of dispensing such products is the inclusion of a plastic scoop in the carton. Such scoops are strong enough to hold the dense detergent powder and possess sufficient integrity so that the powder does not leak as it is scooped from the carton and placed in the wash. However, the use of plastic scoops has been criticized for the ultimate addition of plastic into the environment.

While cups fabricated from paper are known in the art, it is important that the scoop be strong enough to accommodate the dense superconcentrated powdered detergent and possess sufficient integrity that the powder does not sift through the cup and onto the floor when product is being transferred from the carton to the wash. Moreover, the scoop must be small enough to fit conveniently into the superconcentrated detergent cartons.

Struble U.S. Pat. No. 4,267,955 discloses a scoop-type carton said to be most useful for serving of French fries and for providing a carton blank configuration making maximum use of the width of the printing equipment and most economical use of board with the least amount of scrap. The carton blank used to make the carton includes a central side wall, end wall panels on either side of the side wall, a somewhat oval appearing bottom panel below the side wall panel and a second side wall panel below the bottom wall panel.

Russa U.S. Pat. No. 4,915,235 discloses a French fry carton including a tear panel. The Russa carton includes a bottom panel, two end panels attached to the bottom panel, end forming flaps, and a tear out portion in one of the end panels.

Cox U.S. Pat. No. 3,373,917 discloses a foldable container including a handle.

Ullger U.S. Pat. No. 3,073,506 discloses a collapsible container having a bottom portion E folded along scoreline 28 and a bottom portion F folded along scoreline 29.

Berke U.S. Pat. No. 2,749,018 discloses a collapsible tray having a central panel 1 divided in half by a scoreline 10.

Page U.S. Pat. No. 2,226,178 discloses a container having an end section divided into two half sections 21 and 22.

Kohler U.S. Pat. No. 4,428,500 discloses an automatically erectable liquid-type tray which comprises a gusset member 20 including a pair of generally semicircular first and second gusset sections 22 and 24 which are foldably joined between inwardly bowed fold lines 23 and 25 to adjacent sections of first and second inner side wall panels 14 and 16 and which are foldably joined to each other along a straight fold line 27.

Harrod U.S. Pat. No. 1,902,072 discloses a collapsible cylindrical container which can be folded flat when not in use. The container includes a collapsible body and a collapsible wall of a disk shape and a diametrically extending scoreline 21 to permit the walls to be folded in half and to be collapsed with the body of the container.

Main U.S. Pat. No. 1,690,586 discloses a collapsible paper cup.

Alba et al. U.S. Pat. No. 4,711,389 discloses a self supporting food carton which includes a base panel and two upright side panels.

SUMMARY OF THE INVENTION

The invention is directed to a paper scoop and blank for erection thereof which is strong enough to permit consumers to remove superconcentrated detergent from its carton and which can be collapsed to be flat in the carton. In addition, it can be used with minimal effort to remove the last remnants of the product. Also, the collapsible scoop does not permit any powder to sift through the scoop and onto the floor.

The scoop of the invention includes a basket portion and a handle. Pickup of material at the bottom of the carton is facilitated by the shape of the basket in that the front wall of the basket is higher than the rear of the basket. Thus, when only a small amount of product remains, the high front portion of the basket minimizes the number of passes which must be made with the scoop to remove the last portions of the product. The bottom of the scoop is solid and does not permit sifting of the powdered product therefrom.

For a more complete understanding of the above and other features and advantages of the invention, reference should be made to the following detailed description of preferred embodiments and to the accompanying drawings.

DETAILED DESCRIPTION OF THE INVENTION

Figure 1:
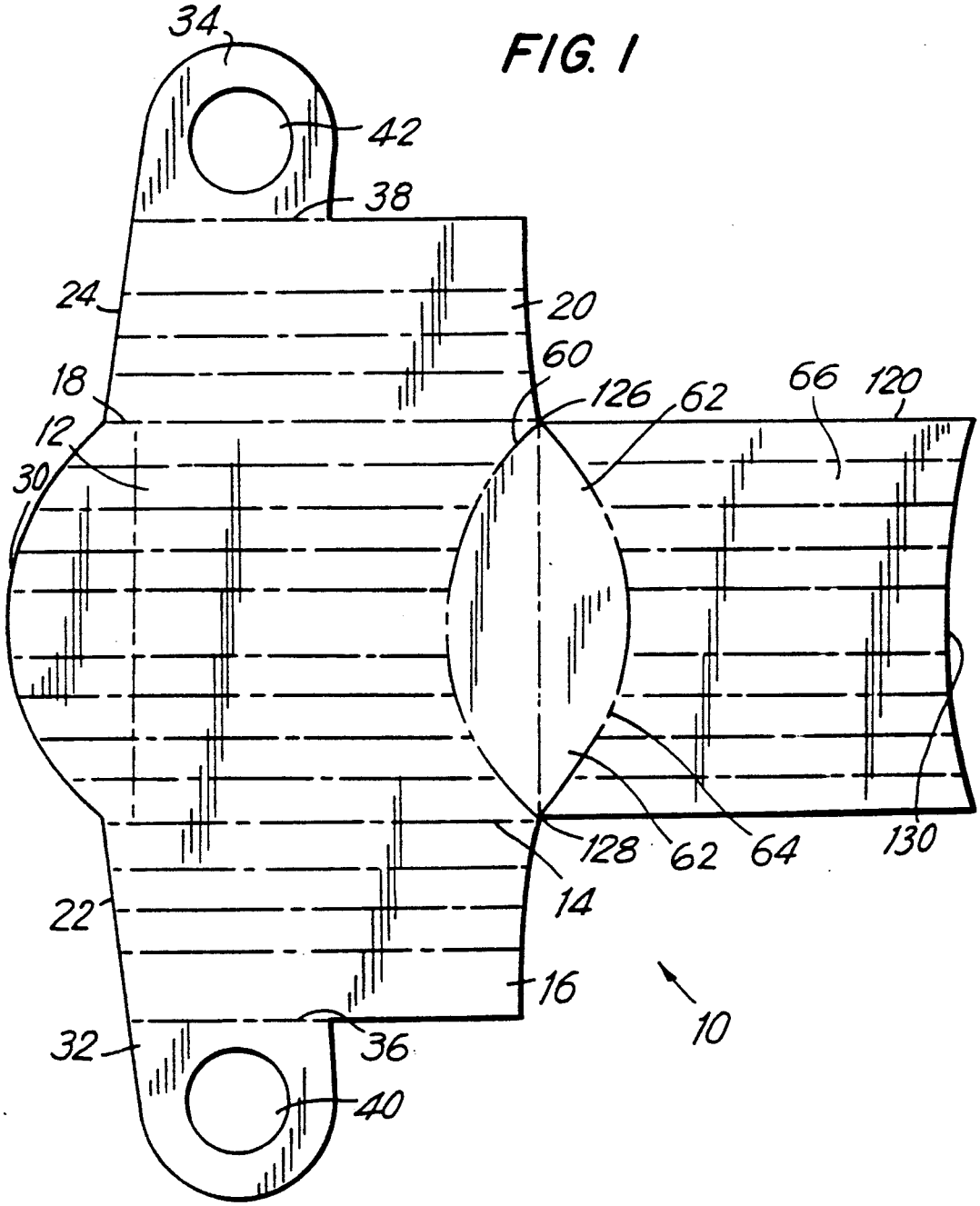
FIG. 1 is a top plan view of a paperboard blank used to form the scoop of the invention.
Figure 2:
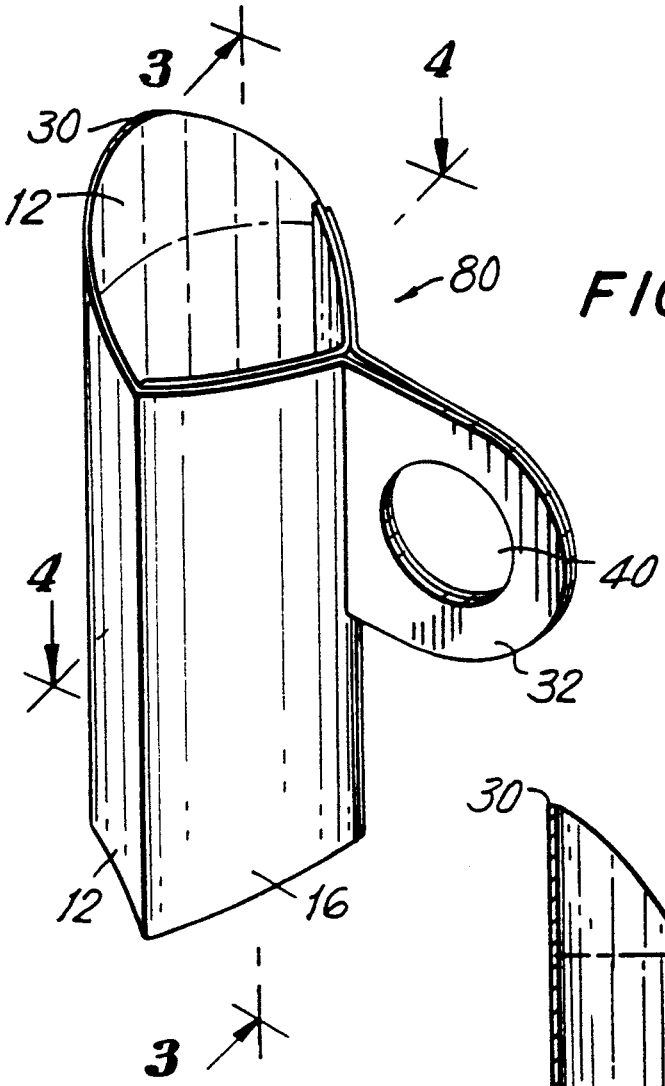
FIG. 2 is a perspective view of a scoop formed from the blank of FIG. 1.
Figure 3:
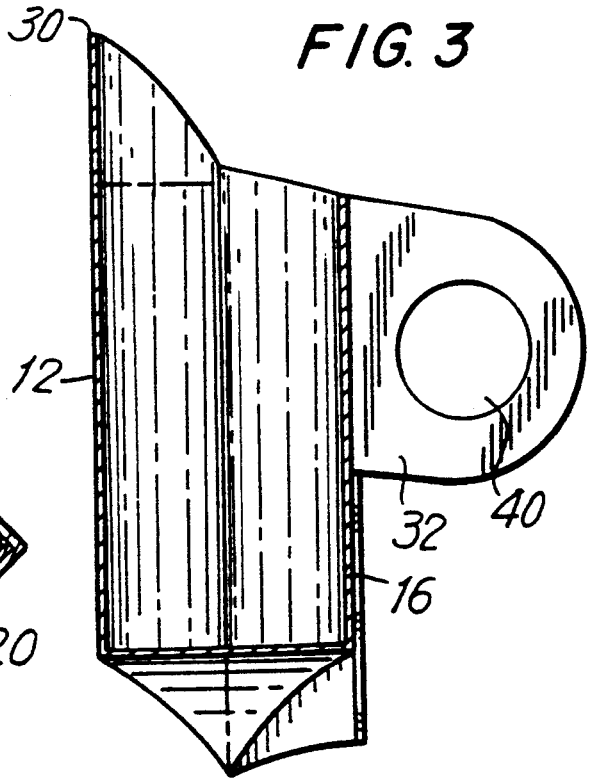
FIG. 3 is a cross section along the lines 3—3 of FIG. 2.
Figure 4:
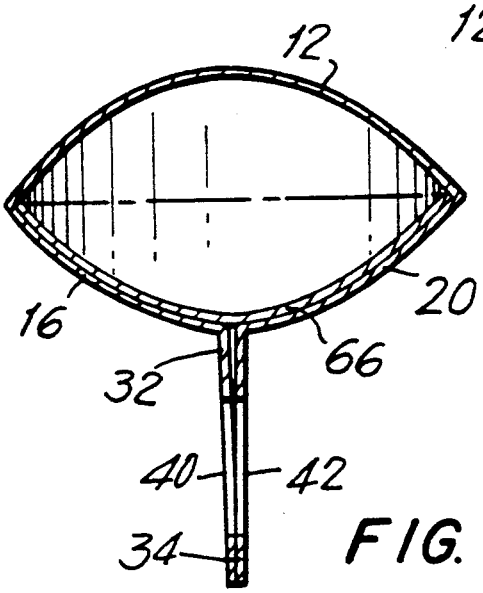
FIG. 4 is a cross section along the lines 4—4 of FIG. 2.

Referring to FIG. 1, scoop 10 includes front panel 12 separated by scoreline 14 from first side panel 16 and by scoreline 18 from second side panel 20. Side panels 16 and 20 include respectively top edges 22 and 24. Front panel 12 includes an arcuate portion 30 which extends above the uppermost portion of top edges 24 and 26.

Side panels 16 and 20 include subpanels 32 and 34 separated from the main bodies of side panel 16 and 20 by scorelines 36 and 38. Subpanels 32 and 34 are rounded and include apertures 40 and 42. Subpanels 32 and 34 will serve as the handle in the erected scoop.

Additional score lines parallel to score lines 14 and 18 may further subdivide first and second side panels 16 and 20. Scoreline 60 defines the bottom edge of front panel 12 and the top edge of bottom panel 62. Scoreline 64 defines the bottom edge of bottom panel 62 and the top edge of rear panel 66.

Scorelines 60 and 64 define a generally oval shaped panel. Each extends from the point 126 where scoreline 18 and rear panel side edge 120 intersect or come closest to intersecting to the point 128 where scoreline 14 and rear panel side edge 122 intersect or come closest to intersecting. Bottom panel 62 is bisected by scoreline 72 which likewise extends from point 126 to point 128.

The dimensions of rear panel 66 largely coincide with those of front panel 12 except that rear panel 66 lacks convex arcuate top portion. As illustrated, rear panel 66 includes a concave arcuate top portion 130.

Scoop 80 is formed by folding bottom panel 62 along bisecting scoreline 72 and bringing rear panel 66 into contact with front panel 12. Side panels 16, 20 are folded respectively along scorelines 14, 18 on top of rear panel 66 and handle subpanels 32 and 34 are adhered together as by gluing. Side panels 16 and 20 are also glued or otherwise adhered to the rear of rear panel 66.

The operation just described forms a generally flat carton which is essentially one dimensional when the handle subflaps 32 and 34 are folded along scorelines 36, 38 to lie in the same plane as the rest of the carton blank. In the flat position, the bottom panel is folded along bisecting scoreline 72. When it is desired to use the carton as a scoop, the carton is fully erected by squeezing the flattened tubular carton blank along scorelines 14, 18, which action tends to cause bottom panel 62 to pop open and form a planar, generally disk-like structure generally perpendicular to the plane of the flattened tubular carton. The carton thus erected is used by grasping the handle, inserting the fingers through apertures 40, 42 and directing arcuate section 30 of front panel 12 to the product which is to be scooped from the container.

The scoop of the invention admits of controlled scooping of the product by virtue of the arcuate section. Moreover, the width of the scoop tends to diminish the possibility that it will be buried under detergent powder or other product as the product settles during transportation and storage.

Preferably, the scoop is made of recyclable paperboard. It is very readily transformed from a generally two-dimensional flattened tubular structure to a three-dimensional scoop. It lays flat when not in use and its curved scoring pattern permits the cup to be formed by manually pressing inwardly in a pincher movement which causes the bottom to snap into position forming a curved, rigid bottom plane. The one piece bottom panel tends to eliminate any possibility of sifting of powdered product from the scoop.

It should be understood, of course, that the specific forms of the invention herein illustrated and described are intended to be representative only as certain changes may be made therein without departing from the clear teachings of the disclosure. Accordingly, reference should be made following appended claims in determining the full scope of the invention.

What is claimed is:

1. A paperboard blank for forming a scoop, comprising:

a) a front panel having a top edge, a bottom edge and two side edges, b) side panels attached to each side of said front panel, c) a bottom panel attached to the bottom edge of said front panel, d) a rear panel attached to the bottom edge of said bottom panel having side edges and having a first side and a second side, e) said blank being formed from paperboard, f) a scoreline generally bisecting said bottom panel, and intersecting the side edges of said rear panel, g) said rear panel being adapted to fold toward said front panel with said first side facing said front panel, and h) each said side panel being adapted to fold toward said rear panel with said second side of said rear panel facing said side panels, i) at least one of the side panels including a handle.

2. The blank according to claim 1 wherein said bottom panel is generally oval.

3. The blank according to claim 1 wherein said bottom panel is formed from score lines.

4. The blank according to claim 1 wherein the front panel is separated from said side panel and from said bottom panel by score lines.

5. The blank according to claim 3 wherein the score lines forming said bottom panel intersect the score lines separating the front panel from the side panels.

6. The blank of claim 1 wherein at least a part of each said side panel is adapted to overlie said rear panel.

7. A paperboard scoop having an inside and an outside, comprising:

a) a front panel having a top edge, a bottom edge and two side edges, b) side panels attached to each side edge of said front panel, c) a bottom panel attached to the bottom edge of the front panel and said bottom panel including a bottom edge, d) a rear panel attached to the bottom edge of said bottom panel, and adhered to the inside of each of said side panels, said scoop being formed from paperboard, said side panels not forming the interior of said scoop, e) at least one of the side panels including a handle.

8. The scoop according to claim 7 wherein said bottom panel is generally oval.

9. The scoop according to claim 7 wherein said bottom panel is formed from score lines.

10. The scoop according to claim 7 wherein the front panel is separated from said side panels and from said bottom panel by score lines.

11. The scoop according to claim 9 wherein the score lines forming said bottom panel intersect the score lines separating the front panel from the side panels.

12. The scoop according to claim 7 wherein said front panel top edge extends to a level above the top edges of the side panels.

13. The scoop according to claim 12 wherein said front panel top edge is arcuate.

14. The scoop according to claim 7 wherein the bottom panel includes a scoreline generally bisecting said panel into two subpanels, one above the bisecting scoreline adjacent to the front panel and one below the bisecting scoreline adjacent the rear panel.

15. The scoop according to claim 14, wherein said scoop is openable from a generally flat first position wherein all elements lie generally in a single plane and said bottom panel is folded along the bisecting scoreline and a second, open, position wherein bottom subpanel extends generally perpendicularly to said first plane.

16. The scoop according to claim 7 which is sift proof.

17. The scoop of claim 7 wherein said bottom panel includes a periphery and the entire periphery is contiguous with at least one of said front and rear panels.

18. A paperboard blank for forming a scoop, comprising:

a) a front panel having a top edge, a bottom edge and two side edges, b) side panels attached to each side edge of said front panel, c) said side panels each including a handle, d) a bottom panel attached to the bottom edge of said front panel, e) a rear panel attached to the bottom edge of said bottom panel and having side edges, f) said blank being formed from paperboard, and g) a scoreline generally bisecting said bottom panel, and intersecting the side edges of said rear panel.

19. A paperboard scoop having an inside and an outside, comprising:

a) a front panel having a top edge, a bottom edge and two side edges, b) side panels attached to each side edge of said front panel, c) said side panels each including a handle and said side panel handles being adhered to each other to form a single handle extending generally outwardly from said side panels, d) a bottom panel attached o the bottom edge of the front panel, e) a rear panel attached to the bottom edge of said bottom panel, and adhered to the inside of said side panels, said scoop being formed from paperboard, said side panels not forming the interior of said scoop.

20. A paperboard blank for forming a scoop, comprising:

a) a front panel having a top edge, a bottom edge and two side edges, b) side panels attached to each side edge of said front panel, c) a bottom panel attached to the bottom edge of said front panel, d) a rear panel attached to the bottom edge of said bottom panel and having side edges, e) said blank being formed from paperboard, f) a scoreline generally bisecting said bottom panel, and intersecting the side edges of said rear panel, g) said rear panel being adapted to fold toward said front panel, h) each said side panel being adapted to fold toward said rear panel rearwardly of said rear panel, i) said front panel top edge extending above the top edge of the side panels.

21. The blank according to claim 20 wherein the front top panel is rounded.

22. The blank according to claim 21 wherein said front panel top edge is arcuate.

* * * * *